US007162415B2

(12) United States Patent
Holzrichter et al.

(10) Patent No.: US 7,162,415 B2
(45) Date of Patent: Jan. 9, 2007

(54) ULTRA-NARROW BANDWIDTH VOICE CODING

(75) Inventors: John F. Holzrichter, Berkeley, CA (US); Lawrence C. Ng, Danville, CA (US)

(73) Assignee: The Regents of the University of California, Oakland, CA (US)

( * ) Notice: Subject to any disclaimer, the term of this patent is extended or adjusted under 35 U.S.C. 154(b) by 848 days.

(21) Appl. No.: 10/288,992

(22) Filed: Nov. 5, 2002

(65) Prior Publication Data

US 2003/0097254 A1 May 22, 2003

Related U.S. Application Data

(60) Provisional application No. 60/338,469, filed on Nov. 6, 2001.

(51) Int. Cl.
*G10L 19/00* (2006.01)

(52) U.S. Cl. ..... 704/201

(58) Field of Classification Search ..... 704/201
See application file for complete search history.

(56) References Cited

U.S. PATENT DOCUMENTS

| | | | | |
|---|---|---|---|---|
| 5,327,521 | A | 7/1994 | Savic et al. | |
| 5,381,512 | A | 1/1995 | Holton et al. | |
| 5,414,796 | A | 5/1995 | Jacobs et al. | |
| 5,490,230 | A | 2/1996 | Gerson et al. | |
| 5,517,595 | A | 5/1996 | Kleijn | |
| 5,729,694 | A | 3/1998 | Holzrichter et al. | |
| 5,839,102 | A | 11/1998 | Haagen et al. | |
| 6,006,175 | A | 12/1999 | Holzrichter | |
| 6,377,919 | B1 | 4/2002 | Burnett et al. | |
| 6,463,407 | B1 | 10/2002 | Das et al. | |
| 6,975,735 | B1 * | 12/2005 | Kinoshita | 381/163 |

* cited by examiner

*Primary Examiner*—David Hudspeth
*Assistant Examiner*—Jakieda R. Jackson
(74) *Attorney, Agent, or Firm*—Eddie E. Scott

(57) ABSTRACT

A system of removing excess information from a human speech signal and coding the remaining signal information, transmitting the coded signal, and reconstructing the coded signal. The system uses one or more EM wave sensors and one or more acoustic microphones to determine at least one characteristic of the human speech signal.

35 Claims, 9 Drawing Sheets

ULTRA-NARROW BANDWIDTH VOICE CODING

CROSS-REFERENCE TO RELATED APPLICATIONS

This application claims the benefit of U.S. Provisional Application No. 60/338,469 filed Nov. 6, 2001 and titled "Ultra-narrow Bandwidth Voice Coding." U.S. Provisional Application No. 60/338,469 filed Nov. 6, 2001 and titled "Ultra-narrow Bandwidth Voice Coding" is incorporated herein by this reference.

The United States Government has rights in this invention pursuant to Contract No. W-7405-ENG-48 between the United States Department of Energy and the University of California for the operation of Lawrence Livermore National Laboratory.

BACKGROUND

1. Field of Endeavor

The present invention relates to voice coding and more particularly to ultra-narrow bandwidth voice coding.

2. State of Technology

U.S. Pat. No. 5,729,694 for speech coding, reconstruction and recognition using acoustics and electromagnetic waves to John F. Holzrichter and Lawrence C. Ng, issued Mar. 17, 1998 provides the following background information, "The history of speech characterization, coding, and generation has spanned the last one and one half centuries. Early mechanical speech generators relied upon using arrays of vibrating reeds and tubes of varying diameters and lengths to make human-voice-like sounds. The combinations of excitation sources (e.g., reeds) and acoustic tracts (e.g., tubes) were played like organs at theaters to mimic human voices. In the 20th century, the physical and mathematical descriptions of the acoustics of speech began to be studied intensively and these were used to enhance many commercial products such as those associated with telephony and wireless communications. As a result, the coding of human speech into electrical signals for the purposes of transmission was extensively developed, especially in the United States at the Bell Telephone Laboratories. A complete description of this early work is given by J. L. Flanagan, in "Speech Analysis, Synthesis, and Perception," Academic Press, N.Y., 1965. He describes the physics of speech and the mathematics of describing acoustic speech units (i.e., coding). He gives examples of how human vocal excitation sources and the human vocal tracts behave and interact with each other to produce human speech. The commercial intent of the early telephone work was to understand how to use the minimum bandwidth possible for transmitting acceptable vocal quality on the then-limited number of telephone wires and on the limited frequency spectrum available for radio (i.e., wireless) communication. Secondly, workers learned that analog voice transmission uses typically 100 times more bandwidth than the transmission of the same word if simple numerical codes representing the speech units such as phonemes or words are transmitted. This technology is called 'Analysis-Synthesis Telephony' or 'Vocoding.'"

U.S. Pat. No. 6,463,407 for low bit-rate coding of unvoiced segments of speech by Amitava Das and Sharath Manjunath issued Oct. 8, 2002 and assigned to Qualcomm, Inc. provides the following background information, "Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the: appropriate coding, transmission, and resynthesis at the receiver, a significant reduction in the data rate can be achieved. Devices that employ techniques to compress speech by extracting parameters that relate to a model of human speech generation are called speech coders. A speech coder divides the incoming speech signal into blocks of time, or analysis frames. Speech coders typically comprise an encoder and a decoder, or a codec. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and then resynthesizes the speech frames using the unquantized parameters."

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a system for removing "excess" information from a human speech signal and coding the remaining signal information. Applicants measure and mathematically describe a human speech signal by using an EM sensor, a microphone, and their algorithms. Then they remove excess information from the signals gathered from the acoustic and EM sensor (which contain redundant information and excess information not needed, for an example, narrow bandwidth transmission application where narrower bandwidth, longer latency, and reduced speech quality are acceptable). Once "excess information" is removed from the signals, the algorithm now leaves a remaining (but different) signal that does in fact have what is needed for coding and transmitting to a listener where it is reconstructed into adequately intelligible speech. The coded signal can be used for many applications beyond transmission to a listener, such as information storage in memory or on recordable media.

The system comprises at least one EM wave sensor, at least one acoustic microphone, and processing means for removing the excess information from a human speech signal and coding the remaining signal information using the at least one EM wave sensor and the at least one acoustic microphone to determine at least one characteristic of a human speech signal. The present invention also provides a method of removing excess information from a human speech signal and coding the remaining signal information using signals from one or more EM wave sensors and one or more acoustic microphones to determine at least one characteristic of the human speech signal. The present invention also provides a communication apparatus. The communication apparatus comprises at least one EM wave sensor, at least one acoustic microphone, and processing means for removing excess information from a human speech signal and coding the remaining signal information using signals from the at least one EM wave sensor and the at least one acoustic microphone to determine at least one of the following: an average glottal period time duration value and variations of the value from voiced speech, a voiced speech excitation function and its coded description, time of onset, time duration, and time of end for each of at least 3 types of speech in a sequences of segments of the speech-types, number of glottal periods and one or more spectral formant values within a continuous segment of voiced speech, the type of unvoiced speech segment, and its amplitude compared to voiced speech, and header-information that describes speech properties of the user.

The invention is susceptible to modifications and alternative forms. In particular, a user may choose to use the invention to code American English into other types of speech segments than those shown (e.g., four types including silence, unvoiced, voiced, and combined voiced and unvoiced segments). Other languages require identification of different types of speech segments and use of timing intervals other than American English (e.g., "click" sounds in certain African languages).

In addition, the coding method primarily uses onset of voiced speech to define speech segments. Speech segment times can be determined other ways using methods herein and those incorporated by reference. The invention herein and reference patents allow these. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1A:
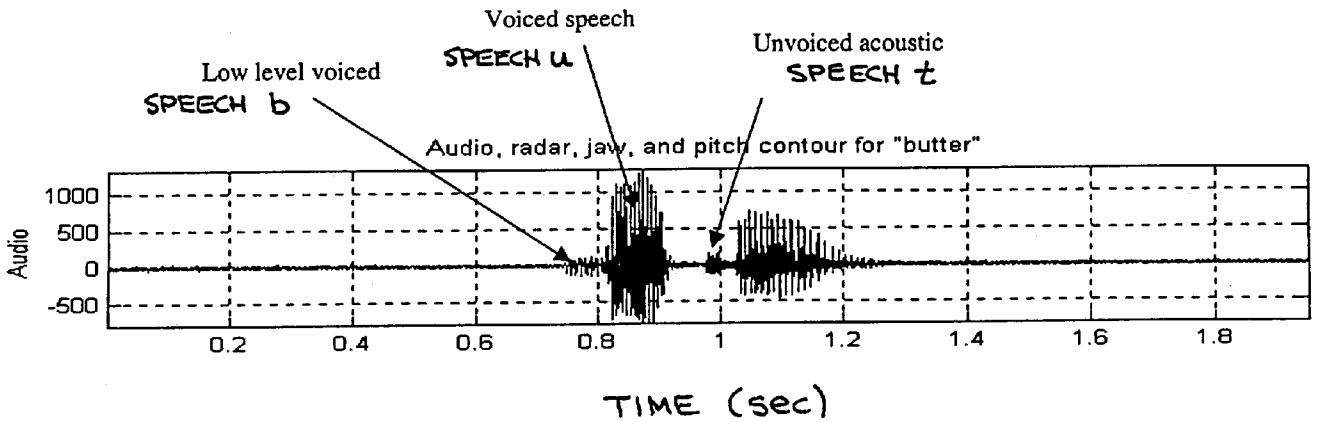
FIG. 1 illustrates several examples of a male speaker's speech for the word "Butter."
Figure 1B:
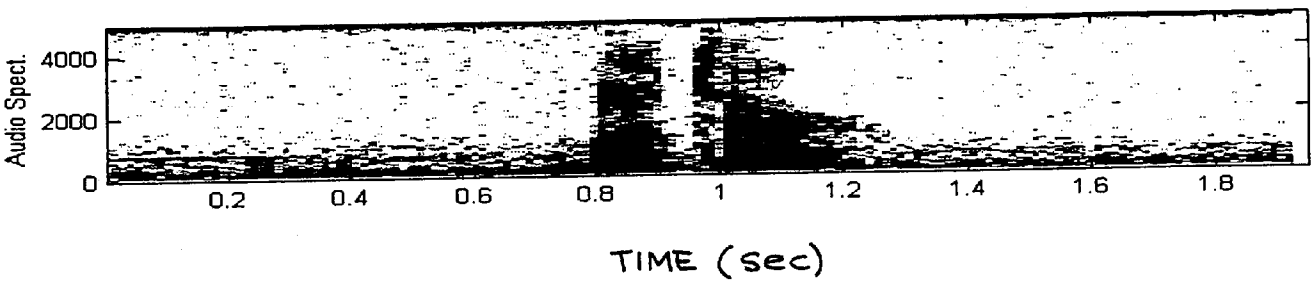
Figure 1C:
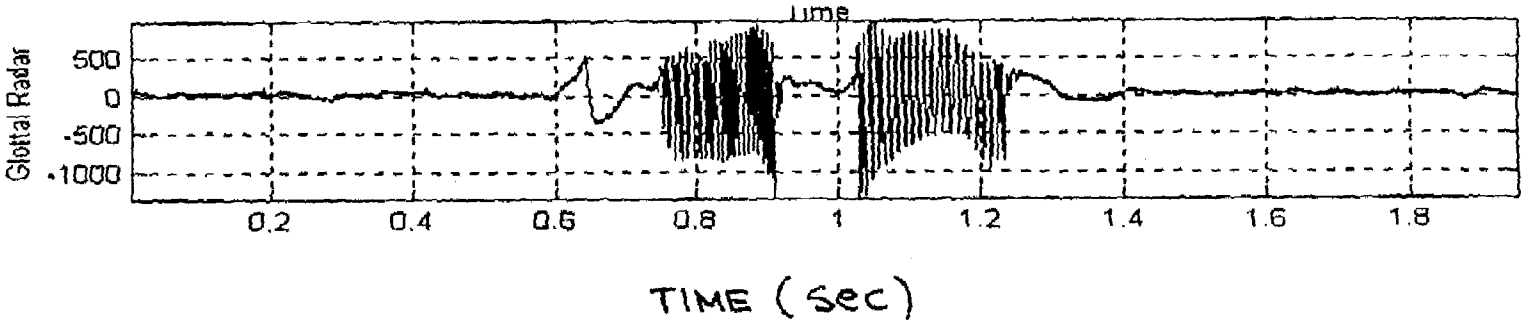
Figure 1D:
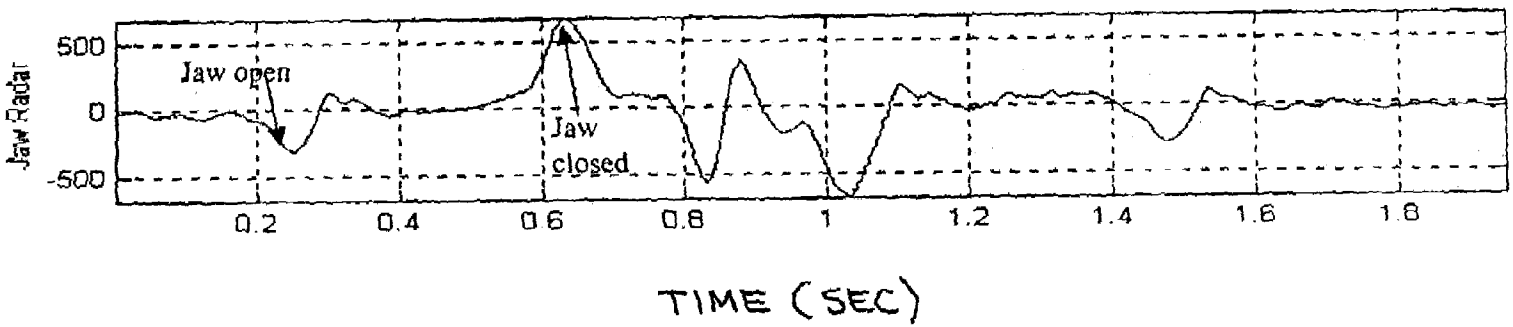

The following information, drawings, and incorporated materials provide detailed information about the invention. Descriptions of a number of specific embodiments are included. The present invention provides systems for reliably removing excess information from a human speech signal and coding the remaining signal information using signals from one or more EM wave sensors and one or more acoustic microphones. These input sensor signals are used to obtain, for example, an average glottal period time duration value of voiced speech, an approximate excitation function of said voiced speech and its coded description. They enable the user of the methods, means, and apparatus herein to identify information contained in a measured human speech signal that is excessive. Herein, excess information means information that may be repetitive (e.g., such as repetitive pitch times), that contains no speech information (e.g., a pause or silence period), that contains speech information spoken too slowly for the rate-of-information transmission desired by the user, or that contains speaker quality information not needed (e.g., information on formats 3, 4, and 5). Other examples of excess information are described herein, and may occur to the user of this information. Using methods herein, the user can decide which information is excessive for the speech coding and transmission application at hand, and can code and transmit the remaining information using the procedures herein. The terms "redundant information" and "excess information" are used at various points in this patent application. The terms "redundant information" and "excess information" are intended to mean multiply transmitted information, unused speech quality information, and unused other information that are not needed to meet the bandwidth, the latency, and the intelligibility requirement for the communication channel chosen by the user.

Embodiments of the present invention provide time of onset, time duration, and time of end for segments of human speech. For the preferred embodiment, each of 3 types of speech (i.e., voiced, unvoiced, and pause) in a sequence of segments of said speech types are coded. However these methods enable coding into other segment types for the linguistic needs of the user. Within each segment of voiced speech, the system counts the number of glottal periods, codes one or more spectral formant values every one or more glottal periods, and then codes the spectral information such that the information needed for transmission is reduced. Embodiments of the present invention determine the type of unvoiced speech during an unvoiced speech segment, and its relative amplitude value compared to the average voiced speech level, and its coded symbols.

Embodiments of the present invention include header-information that describes very slowly-changing speech properties of the user's speech, such as average pitch and glottal period, excitation function amplitude versus time, average spectral formats, and other redundant attributes as needed by the algorithms repeatedly during the coding process. The detailed description and description of specific embodiments serve to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Referring now to the drawings, a number of specific embodiments are described in detail. Introductory information about the specific embodiments and the drawings figures is set out below.

FIG. 1—This figure characterizes a male speaker's speech for the word "Butter." He articulated the /tt/ pronouncing it as a unvoiced fricative, not as /dd/ as American speakers often do, e.g., "budder." This figure shows raw audio data, a spectrogram illustration of said audio data, an EM sensor measuring glottal tissue movements, and a second EM sensor measuring jaw and tongue movement.

Figure 2:
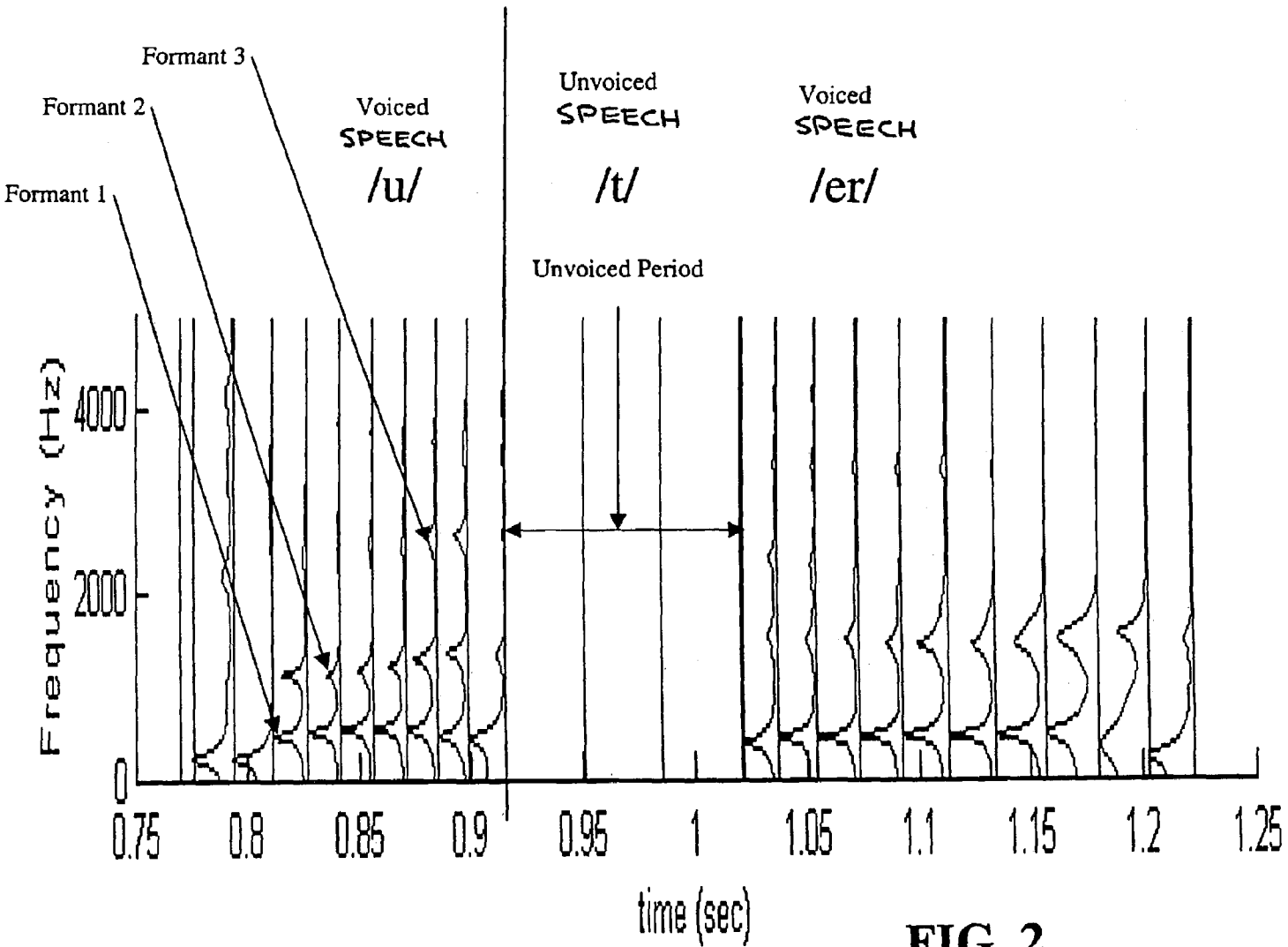
FIG. 2 illustrates the voiced spectral formants for time intervals on either side of the 100 ms unvoiced time segment in which /tt/ is pronounced.

FIG. 2—Shows the voiced speech formants for voiced speech time intervals (i.e., segments) on either side of the 100 ms unvoiced time segment in which the /tt/ in the word "butter" is pronounced as an unvoiced speech segment, wherein there is no glottal tissue movement.

Figure 3:
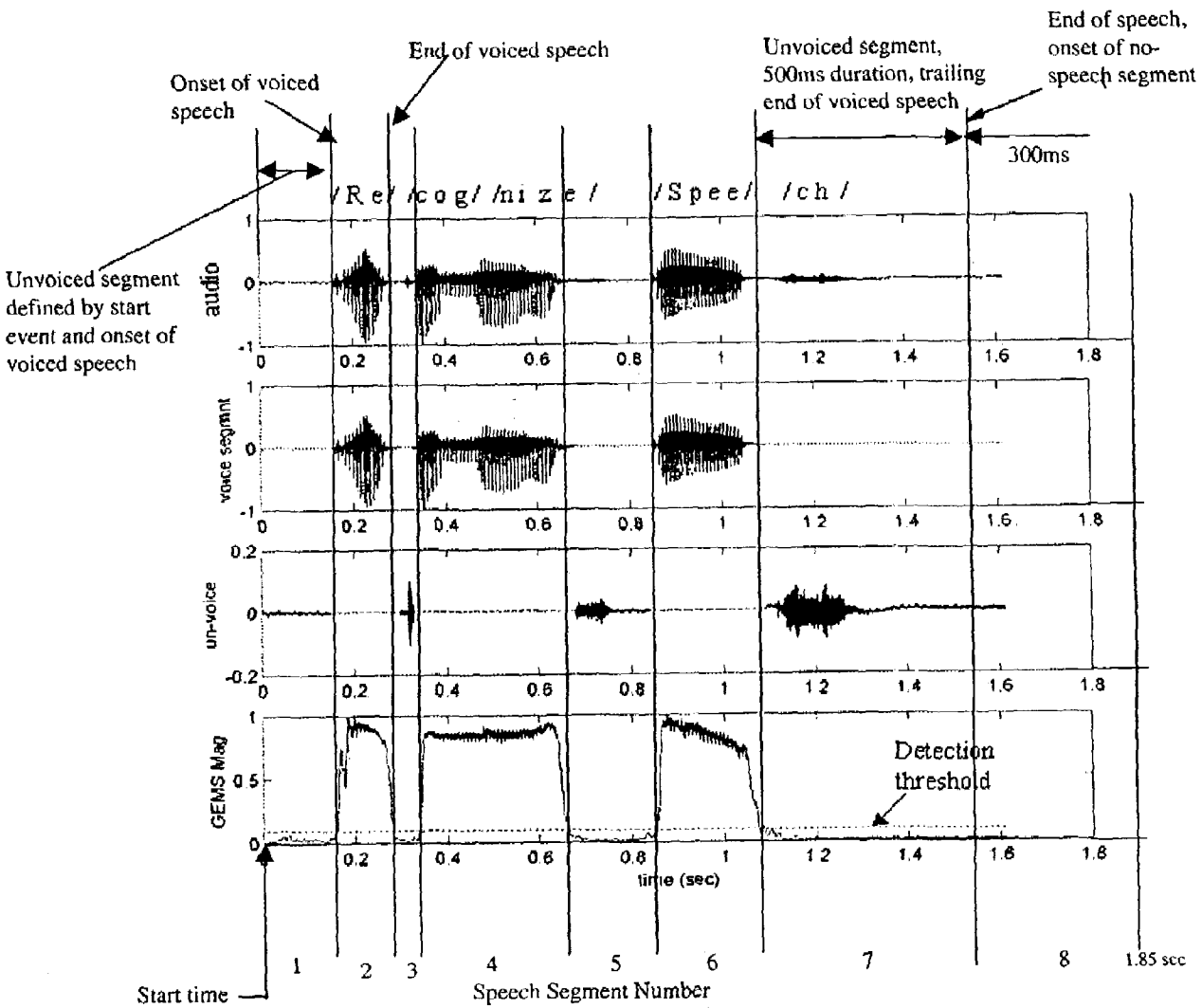
FIG. 3 shows an example of speech segments with segment times.

FIG. 3—Shows speech segmentation procedure using threshold detection of an EM sensor signal to define onset and end of voiced segment timing. The figure illustrates 8 of the many different time relationships of speech segments that are coded using procedures herein.

Figure 4A:
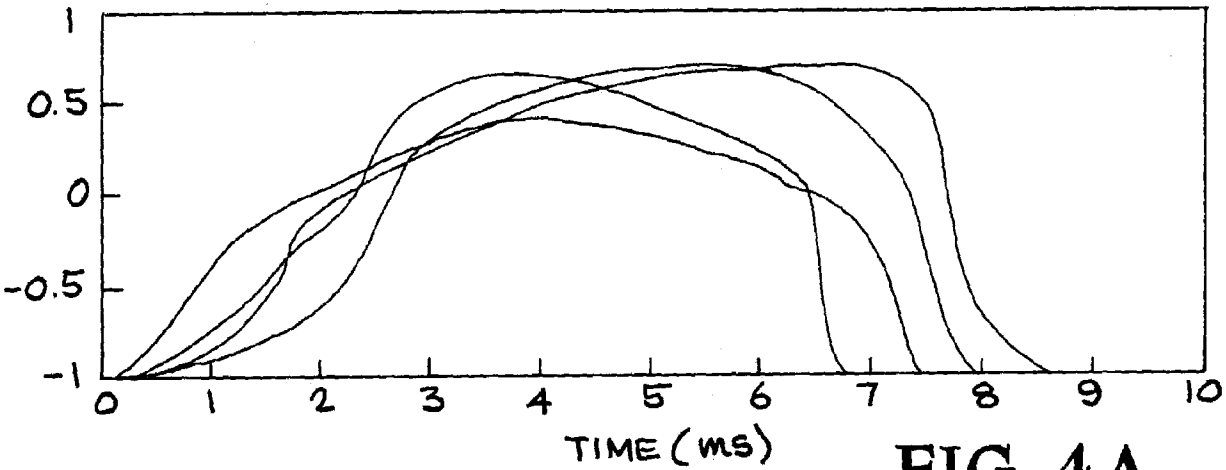
FIG. 4 shows examples of 4 excitation functions and cataloguing process.

FIG. 4A—Illustrates 4 excitation functions from 4 typical male speakers, each with different excitation shapes and different pitch periods (i.e., total time of each excitation). The example algorithm herein for the 300 bps coding of speech, uses such pre-measured excitation functions (measured using the same type of EM sensor as used in the system).

Figure 4B:
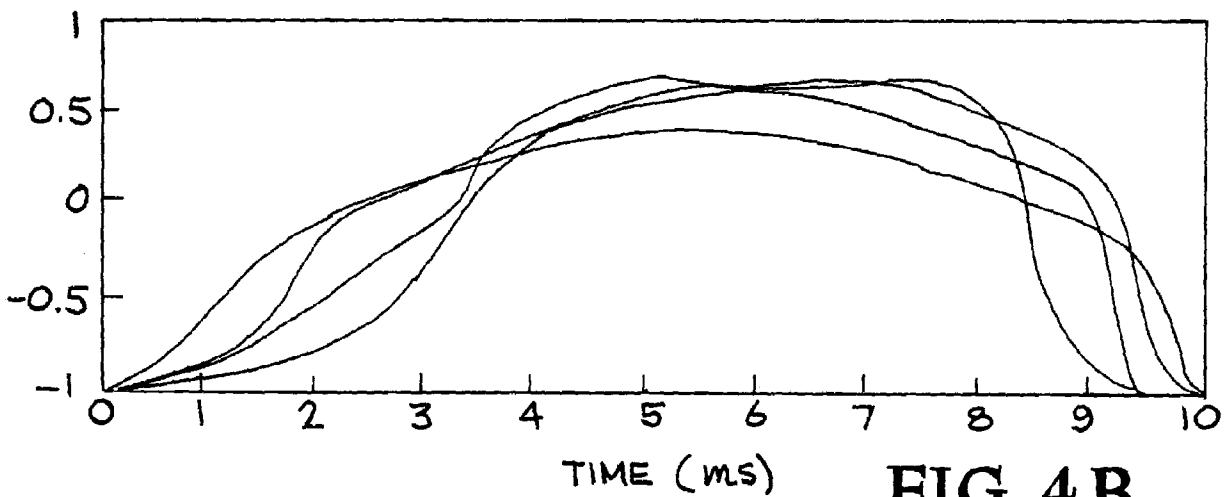

FIG. 4B—Shows the 4 examples of excitation functions in FIG. 4A normalized to a constant pitch period of 10 msec. When an excitation function is measured by an operative system using the algorithms herein, it is first normalized in time (e.g., 10 ms for males and 5 ms for females) and then compared to a catalogue of up to 256 different excitation shapes. The catalogued function with the best match is selected by its code number, e.g., 3 in this example, and its code is placed in the header for subsequent use in both the transmitter and receiver unit. When the coded excitation is used by the algorithms to determine voiced speed transfer functions (and corresponding filter functions), it is expanded (or contracted) to the measured pitch period.

Figure 5:
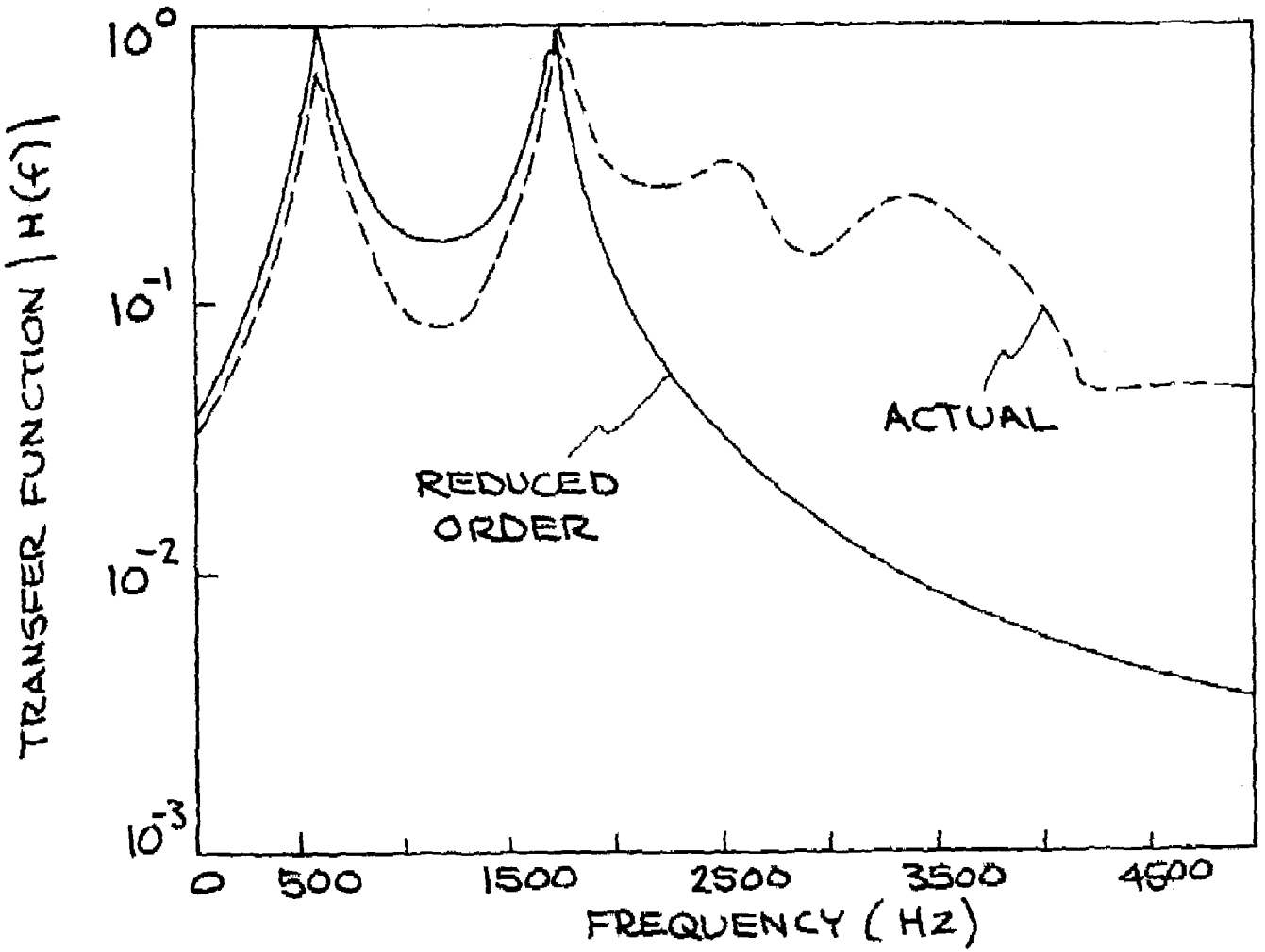
FIG. 5 shows an example of the formants for the sound /ah/, and a two pole, one zero approximation.

FIG. 5—Shows an embodiment approximation to the lowest two speaker formants for the sound /ah/, using two complex poles and one complex zero.

Figure 6:
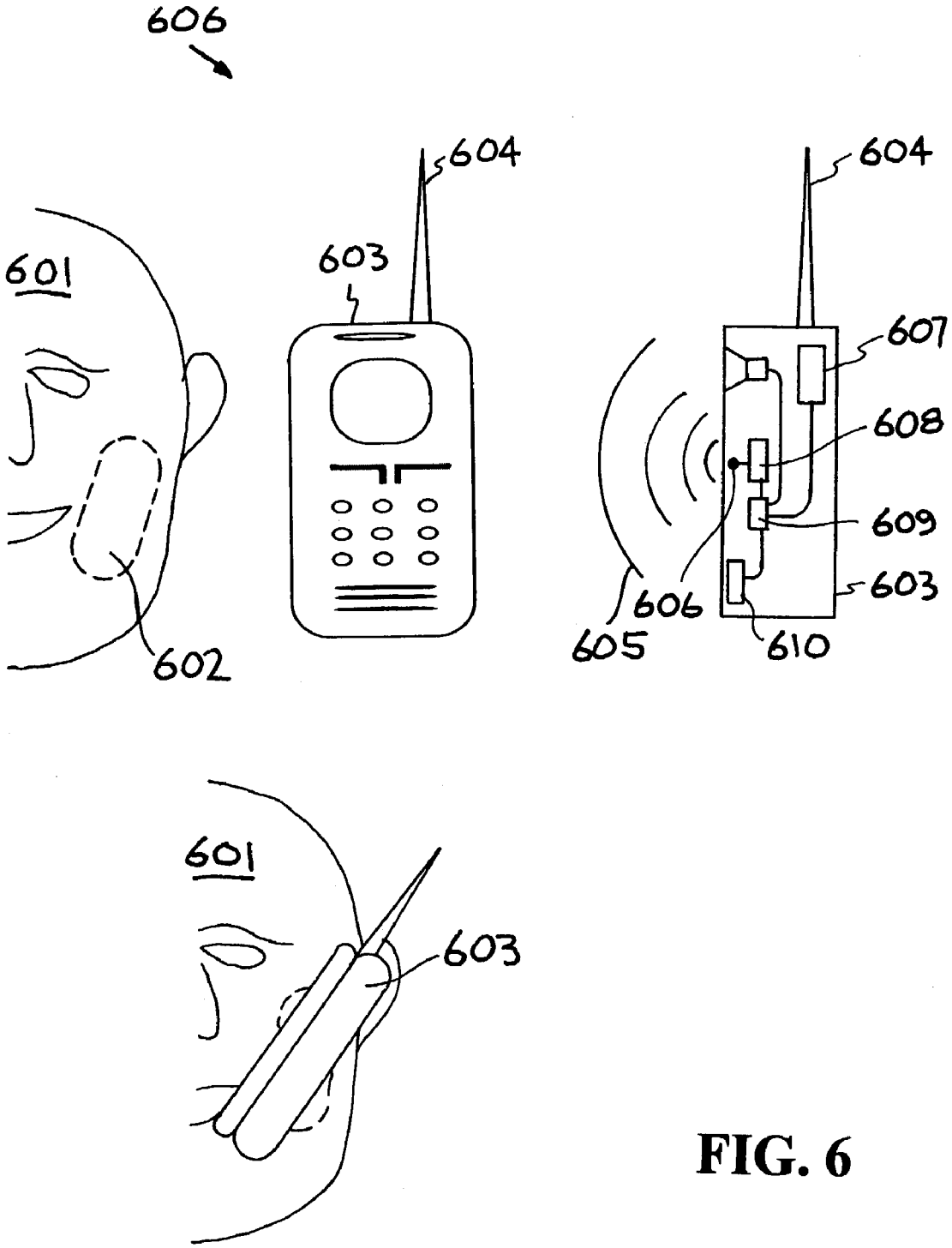
FIG. 6 shows a hand held wireless phone apparatus with side viewing EM sensor.

FIG. 6—Apparatus comprises an EM sensor, antenna, processor, and microphone as placed into a handheld wireless telephone unit and used by a user to measure vocal tract wall-tissue movement inside the oral cavity.

Figure 7:
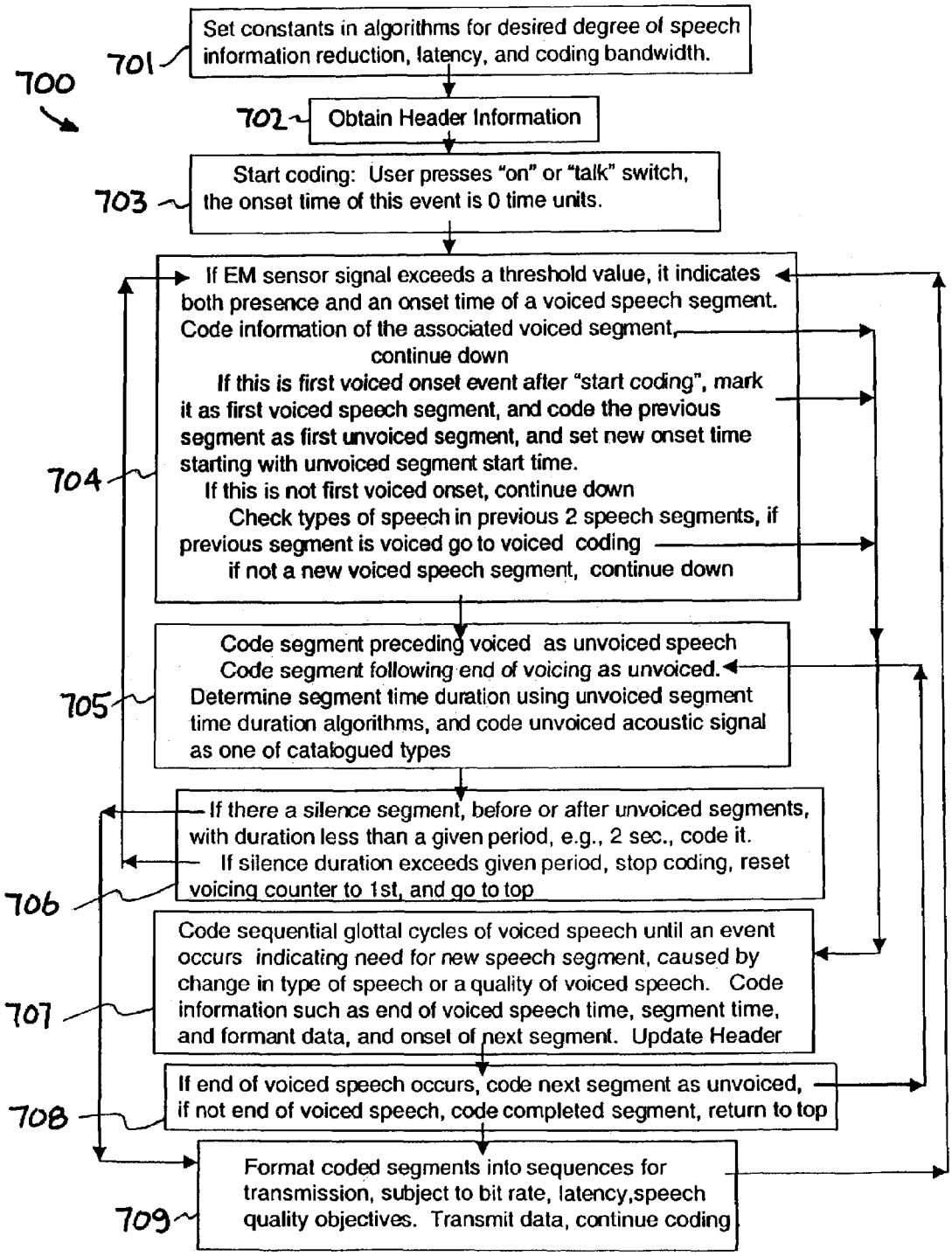
FIG. 7 shows the algorithmic procedures.

FIG. 7—Algorithmic procedure for removing excess speech information for coding and transmission. FIG. 7 describes the logical structure of the inventive methods and procedures herein, noted as 700. The users of these procedures first decide on the transmission bandwidth for the coded speech signals to be used, consistent with the latency and the quality of the user's voice for the application. The algorithms illustrated in FIG. 7, are managed by an overarching, prior art control system that "feeds" signal information from the at least one EM sensor and corresponding Microphone acoustic signal to the algorithms for processing and then it assembles the information into the required transmission coding format imposed by the electronic communications medium. Instruction step 701 illustrates user decisions that result in the coding bandwidth constraint and latency constraint which in turn lead to applications of the inventive coding procedures herein used to achieve the greatest degree of fidelity for each of the types of speech to be coded (e.g., 3 types of speech in the embodiment herein). Similarly, step 702 illustrates one of the important features of the methods herein which is to obtain qualities of the user's speech that are often reused and which can be obtained reliably using methods herein and stored in the header. Two methods can be used to obtain header information. The first is to have the user, in advance of system use, speak a short training sequence of a few words into the apparatus. The system algorithms extract the needed user's characteristic and redundant speech qualities from the sequence and stores them in the header. A second approach is that the algorithm recognizes onset of speech, in step 704, and extracts the needed header information from the first few 100 ms of voiced speech, and continues coding. For the 300 bps example, these qualities are obtained in less than 0.1 second of speech, and include the user's average pitch rate, the glottal pitch period, and the average voiced excitation function. For improved speech coding employing coding bandwidth greater than 300 bps, in addition to those header parameters chosen for the 300 bps example, the header algorithm would obtain pitch variation profiles as the user is asked to repeat one or two questions by the apparatus, it would use a larger catalogue of voiced excitation functions to characterize the user's voiced speech, it would obtain average voiced speech formant values for 3 or more formants, and it would select one or more customized catalogues for unvoiced speech phrases preceding and following voiced segments, which are matched to the user's articulation of unvoiced speech units, from one or more stored catalogues of unvoiced speech units.

When the user starts to use the methods and apparatus herein for communicating, he/she will turn it on with a switch, step 703. The switch places the unit into a waiting mode until a voiced excitation is detected in step 704. The switch also sets the $1^{st}$ voiced speech marker to "yes," awaiting the first time of voiced speech onset. Alternatively, the communicator system can ask the user to repeat a short word or phrase to provide new or updated header information, then set the first time voiced speech marker to "yes," and place the unit in a wait mode. In the 300 bps example, the user pushes a button that turns-on a switch that puts the system into a waiting mode, until in step 704 an excitation is detected and the system begins coding. Also in this example, the start time t is set to zero with button turn on, and the time from button press to first voiced speech onset is counted in units of 2 glottal cycles (e.g., about 20 ms per unit for male speakers). Finally, if the user stops speaking for about 2 seconds, the system reverts to a waiting mode until a 1st voiced excitation onset is detected.

In step 704, when a voiced excitation is detected by one or more EM sensors, the event causes the algorithm to test the $1^{st}$ voiced speech onset marker for a "yes," to test if this voiced excitation onset event is the onset of the first voiced segment after system turn on, or if it is identifying the repeating onset of voiced speech segments during normal speech articulation. This step 704 also identifies several other events such as the next voiced speech onset during a long voiced speech segment which must be parsed into shorter segments, or when significant voiced formant changes are detected and a new voiced speech coding sequence must start to code them. Also in step 704, if the event is first voiced speech onset, corresponding to the first utterance of voiced speech after system turn-on, the onset of coding time is set to be the beginning of the unvoiced speech segment preceding the $1^{st}$ voicing onset. As described above in the methods for unvoiced coding, and in step 705, the default time duration of an unvoiced segment preceding voiced speech is 300 ms. Thus the coding system will begin coding the stream of speech, after button press, starting at the 1st voiced onset time minus 300 ms. This time is defined as the new zero time. Then this algorithm sets the onset of voiced speech to occur 300 ms after system turn on. This time is coded as 300 divided by the (number of 2-glottal period units), or about 15 units of time (in this example), made up from double glottal periods, e.g., 2×10 ms=20 ms coding periods. It is often the case that the button press time to the first onset time of voiced speech (e.g., see FIG. 3 speech segment 1) is less than the average unvoiced speech segment time duration of 300 ms. In this case the shorter time duration (in double glottal time period units) is used to code the time of voiced speech duration, and the button press time is the onset time of coding. Once the 1st voiced speech onset marker for the first voiced speech segment is recognized as "yes," it is then changed to a marker for recurring speech such as "no," and stays in this state until a new system start time is defined as in 703 or in 706.

If the onset of voicing test, step 704, notes an onset time for a recurring voiced speech segment, the algorithm checks for the type of segment preceding this onset of voiced segment (e.g., in FIG. 3, the second voiced segment onset time at the beginning of segment 4 is preceded by a short unvoiced segment). If it was unvoiced the algorithm proceeds to steps 705 and then 706. If the previous segment was a voiced speech segment, then the algorithm proceeds to algorithm-step 707.

Step 707 codes the newly identified voiced segment every two glottal cycles (in the example herein) until one of two events occur. The first event is if end of voiced speech occurs (e.g., when the EM sensor signal falls below a threshold value for a predetermined time), upon which the algorithm proceeds to step 708. In step 708, the speech segment following the end of voiced speech event is labeled as unvoiced, and the algorithm goes to step 705 to code the unvoiced segment following the end-of-voiced speech time. In the second event, if the spectral formant coding algorithm senses a change in a formant spectral parameter that exceeds a predetermined value in a short time period (i.e., over a predetermined number of glottal cycles), it will signal an end of the present voiced speech segment coding, and set an end time. (For example, in FIG. 2 note the change in formant-2 over the 4 glottal cycles between time period 0.8 sec and 0.83 sec.) Upon sensing an end to a sequence of 2-glottal-period smoothly varying formants of voiced speech, the algorithm then proceeds to step 709, where the recently coded voiced speech segments and others, according to the speech type, are further coded to meet bandwidth, latency, and transmission format requirements. The algorithm then returns to step 704, proceeding to identify and code the next speech segment.

In step 705, an unvoiced speech segment is identified as preceding or trailing a voiced segment, and is coded accordingly using catalogued values. If the unvoiced speech segment time duration can not be set as a default value, for example because it is positioned between 2 voiced segments or positioned between"system on" to the 1st voiced onset time, then the algorithm selects time durations appropriate for the conditions and adjusts the catalogue comparison and identification of unvoiced speech type accordingly. After the unvoiced segments are coded, the algorithm proceeds to step 706 to test for speech silence times.

In step 706, the algorithm tests to see if there is a period of silence time (no speech) before the onset time of the unvoiced speech segment preceding an onset of a voiced segment. Such silence segments also commonly trail the most recently coded voiced speech segment, starting after the end time of the corresponding trailing unvoiced segment. If a silence period is present, its onset time is the time of the end of unvoiced speech time of a trailing segment. (Silence onset also occurs commonly at system start time, discussed in 703 and 704). As an example, the beginning of segment 8 in FIG. 3 illustrates the onset of a period with no speech, trailing an unvoiced period after the last voiced period. This period of no-speech (also called silence herein) will stop at the beginning of the next unvoiced segment (which precedes the next voiced segment), or it will terminate if the system automatically stops coding after waiting for a while (e.g., after 2 sec. of no-speech). Such periods of no speech are coded in step 706, and such periods are commonly used by the system transmitting algorithm, step 709 to format and send coding from other speech segments at a constant bit rate.

FIG. 8—Shows examples of an original speech segment, a reconstructed speech segment using prior art LPC 2.4 kbps method, a method called GBC 2.4 kbps using Glottal Based Coding (i.e., GBC coding) of the methods herein, and a 300 bps coding method using methods, means, systems, and apparatus herein.

The present invention is directed to an outstanding speech coding problem that limits the compression (i.e., the "narrowness" of bandwidth) of presently used coding in communication systems to about 2400 bps. For purposes of this application, the procedures used to minimize coding bandwidth is to remove all or substantially all excess information from a user's speech signal, which may or may not distort the user's voice, depending upon the application. In communication systems these techniques are often called vocoding, or minimal bandwidth coding, or speech compression. The reasons for the minimal bandwidth coding limit of about 2400 bps in prior art systems are that existing speech coding systems, based on all-acoustic signal analysis, can not reliably determine needed speech signal information in environments of uncertain noise levels. In contrast, the embodiments described herein have been shown by applicants to code speech intelligibly and reliably using a bandwidth of 300 bps or less.

Examples of difficulties with existing speech coding systems include obtaining reliable speech start time, identification of the types of speech being spoken, and whether the acoustic speech signals are actually speech or background noise. The present invention is directed to solving those difficulties by using information from one or more EM sensors and from one or more conventional acoustic microphones in a variety of ways.

Three types of speech are normally considered during the processing of an acquired segment of human speech. They are silence (i.e., no speech from the user), unvoiced (also called fricative speech herein), and voiced speech segments. Detection of onset, duration, end of speech type, and methods of minimal coding of each of these said three types of speech are described. Existing all-acoustic speech coding systems do not reliably determine the glottal opening and closing time periods that define voiced speech time periods, usually called pitch periods (which are needed for efficient coding). Also, they do not reliably determine information on the source function of voiced speech (the excitation function), which is needed for efficient coding of the voiced speech spectral formants. Without information on voiced speech onset, duration, and end times, it is not possible, especially in conditions of sporadic or noisy environments, to reliably determine the types of unvoiced speech that normally precede and follow voiced speech segments. It is also not possible to identify periods of speaker silence because background noise commonly sounds like speech to existing acoustic signal processors.

It has been demonstrated that low power, electromagnetic wave sensors can measure the motions of vocal tract tissues below the glottal region of the human vocal system, at the glottal region, and above the glottal region in the super glottal region, pharynx, oral cavity, and nasal cavities. Applicants have described a variety of direct and indirect techniques for obtaining said measurements of tissue motions and relating these measurements to excitation functions of voiced human speech. Furthermore, they have described embodiments and procedures for determining three types of speech being normally produced in American English—silent, unvoiced, or voiced—and how to most efficiently describe each of these types of speech mathematically. Finally, they have shown how these mathematical descriptions can be formatted into vectors of information (i.e., "feature vectors") that describe speech over automatically determined time frames, and how to transmit speech codes over wired and wireless communication systems.

Applicants have shown that by using the EM wave/acoustic sensor methods herein, as well as using those included by reference, it is possible to determine all of the information needed to reliably remove excessive information from speech segments, and to reliably compress speech to narrower bandwidths than possible with existing systems. In addition, the embodiments use less computing and less processor power than existing systems. The embodiments use said information such that a minimal amount of bandwidth is needed to send coded speech information to a receiver unit, whereupon the coded speech signal is reliably and easily reconstructed as intelligible speech to a listener. Furthermore, the embodiments herein allow the user to manually or automatically adjust the coding procedures to alter the intelligibility (or conversely degree of distortion) of the coding. For example, the user can trade-off a speaker's speech-personality quality and the transmission latency (i.e., delay) time in favor of a reduced coding-bandwidth.

Applicants describe and claim new and detailed algorithmic procedures for using EM sensor information and acoustic information to first efficiently encode an acoustic speech utterance into a numerical code, then to transmit binary numbers corresponding to the code (assuming digital transmission), and finally to reconstruct the speech utterance, with a predetermined degree of fidelity at a receiver. In addition, applicants point out that the inventive method of coding can be used for speech storage. By efficiency of coding Applicants mean:

1) Reduced bandwidth of the transmission channel keeping speech quality at a constant value.

2) Improved speech quality transmission keeping the bandwidth of the channel constant 3) Easily modifying both the bandwidth of transmission and the quality of the speech into unusual transmission formats, such as slower transmission leading to slower than real time reception and reduced speaker personality, leading to use of very narrow bandwidth, coding, e.g., <300 bps.

4) Reducing the number of calculations needed by the microprocessor or the DSP or analog electronics (and thus reducing battery power) to code the speech into a low bandwidth signal.

In some embodiments applicants concentrate on an example of a very narrow-bandwidth vocoding system, using 300 bps±100 bps of coding bandwidth to code three types of speech for demonstrating the various methods and embodiments. This is a communications niche of particular interest to military and commercial communications. The terms narrow bandwidth and low bandwidth are used interchangeable herein. The use of the term "time-period" means (unless otherwise noted) the calculation of the time of duration of a speech segment time-period, as well as the the location of the onset and end of a speech segment time-period in a sequence of other speech segment time periods. The determination of said speech segment time-period information is usually conducted by using measured or synthetic times of glottal periods as the unit of time measurement.

FIGS. 1 and 2 illustrates a speech segment with the three types of speech to be encoded in this embodiment for American English. They include a rapid unvoiced fricative, /tt/, in the sound "butter." FIG. 2 shows the formant structure of the voiced speech segments in the sound "butter," located in time on either side of the fricative /tt/. The voiced segments are coded differently from the unvoiced and no speech segments. Note that the unvoiced segments do not carry very much information per unit time interval, where as the voiced segments carry quite a bit of information. Silent speech segments (also called pauses herein), occur often during normal speech, and must also be identified and their time duration minimally coded to enable natural reconstruction of the speaker's speech segments into natural sounding time sequences that are heard by a listener, using a receiving unit.

The embodiments herein describe a speech coding procedure that begins by identifying onset of speech (usually defined as time t=0). The method then begins to collect the speaker's speech information, processes it, and then begins to transmit the information to a receiver. The first information to be transmitted, typically during the first 0.1 sec, is called a "header." The onset of speech event can be signaled by the speaker pressing a button on his/her microphone (or other existing method) or the onset time can be automatically determined by measuring a signal from the EM sensor that senses movement of a speech organ that reliably signals speech onset. This embodiment defines on-set of speech in one of two ways depending on how the EM sensor is used. The first is by using the EM sensor signal to measure the beginning of vocal fold movement and sending its signal to a processor. The processor compares the measured glottal signal to a predetermined threshold level (see FIG. 3), which if it exceeds a predetermined threshold, defines a voiced speech onset time. Then the algorithm subtracts a value of 300 ms from this onset time and defines a start time. (The 300 ms period preceding voiced speech onset, in this example, is a time period during which unvoiced speech commonly occurs for a representative cohort of speakers. It can be adjusted as desired for different cohorts). In the case of the first onset time of voiced speech, the actual start time of speech coding can be less than the default unvoiced speech segment duration of 300 ms. See FIG. 3 segment 1 for such an example.

The second onset of speech method uses a measurement of movement of a targeted section of vocal tract tissue, caused to move by air pressure impulses released as the glottis opens and closes. The air impulses then travel up or down the air in the vocal tract, at the local sound speed to the targeted tissue, causing it to move (e.g. typically 5 micrometers for the internal cheek wall). A typical travel time is 0.5 ms from glottal opening to the example internal cheek tissues (which defines the sides of the vocal tract, also called a vocal organ, at the location in the vocal tract called the oral resonator cavity). Conversely, if the EM sensor signal drops below a predetermined threshold signal, averaged over a predetermined time interval, the processor will note this time as an end of voiced speech segment time. The time period between onset and end is the duration time of a voiced speech segment.

The header, in an example narrow band coding scheme, contains at least the following information: onset time of speech, average pitch of the user, male/female user, excitation function, it contains information that updates the algorithms in the receiver by transmitting the speech qualities of the person speaking, such as (but not limited to) his/her pitch, changes in pitch, and average voiced speech formant positions.

The algorithm herein makes use of one or more existing preprocessor algorithms (for additional details see U.S. Pat. No. 6,377,919 to Greg C. Burnett, John F. Holzrichter, and Lawrence C. Ng for a System and Method for Characterizing Voiced Excitations of Speech and Acoustic Signals, Removing Acoustic Noise from Speech, and Synthesizing Speech, patented Apr. 23, 2002 for speech coding, reconstruction and recognition using acoustics and electromagnetic waves that can remove background noise from the speech segments before the methods this application are applied. U.S. Pat. No. 6,377,919 is incorporated herein by reference). Other existing algorithms, incorporated herein by reference, include U.S. Pat. No. 5,729,694 to John F. Holzrichter and Lawrence C. Ng for Speech Coding, Reconstruction and Recognition Using Acoustics and Electromagnetic Waves, patented Mar. 17, 1998 are used to determine the average pitch and pitch periods of the user, as well as pitch variation. They identify the timing of transitions between the three speech types, generate time markers for transitions and glottal cycles, determine excitation function parameters, normalize the amplitudes of excitation and peak formant values, find average spectral locations, amplitudes, and timing of two or more voiced speech formants, and identify unvoiced speech segments as one of several types (for example, three types as shown in FIG. 4) and normalize and code the sequence of speech segments that make up voiced speech. The algorithmic methods herein arrange that information sent by the transmitter and is primarily directed toward describing speech deviations from the normalized or default values described in the header. For purposes of example, a speech segment lasting 3 seconds may consist of 1.5 sec of continuous (but with changing formants) voiced speech, 0.5 sec of pause, and 1.0 sec of two unvoiced speech segments, which are all coded at 300 bits per second, and then transmitted.

Header—The embodiment described herein uses a short information "header" to alert a receiver and to update the algorithms in the receiver unit's decoder for subsequent decoding of the compact coding format impressed on the transmitted medium (e.g., radio wave, copper wire, glass fiber), that enters the receiver, which is then turned into recognizable speech. The information needed in the header can be automatically obtained during the first moments of use, or it can be obtained at an earlier time by asking the user to speak a few sounds or phrases into the EM sensor/acoustic microphone located inside the apparatus. Such training phrases enable the algorithm in the input unit to accurately determine the user's glottal cycles (i.e., pitch value and pitch period), excitation function, user's voiced formant spectral value average and deviations, unvoiced speech spectral character, etc.

A male or female indicator uses 1 bit to indicate male or female, and it uses 4 bits to describe the 50 bps variation of the user's pitch over that of an average male or female speaker. For example, an average male's pitch covers 90 to 140 bps, or an average female's pitch values cover 200 to 250 bps. The glottal period or glottal cycle time period is the value of 1 second divided by the pitch value. For minimal coding in the preferred enablement, four bits (1 in 16) are used to code minimally perceptible pitch value variations of 5 Hz over a pitch range of 50 Hz variable range of the average male or female user's average pitch value. This coding uses 4 bits. Alternatively, the average pitch can be coded using 7 bits to obtain 1 part in 128 accuracy—about 1% accuracy. The header values are reset automatically every 5 seconds of speech, or more often if the algorithm detects a large change in speaker information due, for example, to a speaker's question or to speaker stress, fatigue, or change in vocabulary usage. Thus if 7 bits are coded each 5 sec., the coding bandwidth averaged over 5 sec., is about 1.4 bps. If the user wants to add additional prosodic information coding small changes in pitch rise and fall, this can be added as desired. In the preferred enablement, the pitch profile is coded at the beginning of a voiced segment that exhibits prosodic variation. The example herein of determining the user's normal pitch then coding it using 7 bits, and then storing the 7 bits in a header so it can be used for 5 seconds of subsequent coding and transmission, shows how redundancy (i.e., excess information) of speech is removed using methods herein. In contrast, a user's normal speech signal carries the pitch period information, in every 5 to 10 ms interval of voiced speech, which if coded completely would require over 700 bits per second of coding information only for the pitch information.

The header also contains information to code the characteristics of the excitation function of the speaker. The amount of information to be coded depends upon how the EM sensor or sensors in the system are used and what information is needed to meet bandwidth, speech personality, latency time, or other user objectives. If an EM sensor is used at the larynx location of the user, its signal provides a great deal of information on the shape of the glottal opening versus time, which can be used to estimate a voiced air flow excitation function. (The glottis is the opening between the vocal folds as they open and close during voiced speech.) If the EM sensor is used in the super-glottal region, the pharynx region, or the oral cavity of the vocal tract to measure pressure induced tissue movement, a pressure excitation function can be estimated. (In this application, superglottal means the vocal tract region above the glottis, the pharynx is defined in texts on speech physiology (see "Vocal Fold Physiology—Frontiers in Basic Science," by Ingo R. Titze, National Center for Voice and Speech, 1993, NCVS Book Sales, 334 Speech & Hearing Center, University of Iowa, Iowa City, Iowa 52242, and "Principles of Voice Production" Ingo R. Titze, Prentice Hall, 1994 incorporated herein by reference) and is approximately the region of the vocal tract from a few cm above the glottis up to the tongue back. Herein the superglottal region includes all parts of the vocal tract above the vocal folds, including but not limited to the pharnyx region. Also, the oral cavity is defined in speech physiology texts (see Titze above) and is approximately the branch of the vocal tract extending from the back of the tongue to the teeth, and sometimes to the lips. The coding of the excitation function in the header is described further below.

The header may also contain information on the spectral formants of the speaker. These are essentially the filter pass-band frequencies of the user's vocal tract. Commonly (see FIG. 2) at least 3 to 4 spectral formants are determined by using well known ARMA, ARX, and other spectral transform embodiments that are used in this application because sufficient information on the excitation function is available. In particular, these embodiments can mathematically describe one or more sets of "poles" and "zeros" which approximate the formants' filter properties. These prior art methods are incorporated herein by reference. For minimum bandwidth coding it is often useful to include average spectral values of the formants, from which deviations from normal speech can be coded and transmitted. For the minimal bandwidth example of the methods herein, the two lowest frequency formants, #1 & #2, (see FIG. 2) are coded using 2 complex poles and one complex zero, representing 6 information values (see also FIG. 5). Typically 8 bits are used for each of the 6 values, using 48 bits. For the 300 bps coding example, these values are not used in the header.

It is understood that the absolute numerical values used above, and below, in the algorithmic examples are typical and may be changed for specific applications and to accommodate specific or average sets of individuals who would be users of the minimal bandwidth coding embodiments of this application. It is also understood that other information, besides the speech-coding header information described herein, is often sent as a header during signal transmission, in both wired and wireless communication systems, for purposes of enabling a robust communication link. In particular, for best use of the methods of this application, an adaptive transmission protocol should be employed to maintain constant transmission bandwidth with varying rates and types of coding of the remaining speech information after the excess is removed. The bandwidth minimizing concepts herein, based on redundancy elimination, lead to minimal speech coding bandwidths noted in bps (bits per second), and do not include extra bandwidth associated with communication system operation.

Excitation—Applicants have shown that the shape of the speaker's voiced excitation function can be described by as few as 3 separate numerical value. They are the glottal period time (coded by 6 to 8 bits, see above), the amplitude (2–3 bits), and the shape of the speaker's excitation function as captured in a catalogue of prior measured excitations from a representative group of users of the apparatus, systems, and using methods herein. See FIG. 4A for an example of raw excitation functions of 4 male speakers, and the time normalized versions of said excitations in FIG. 4B. A catalogue of 64 types of normalized excitations can be conveyed using 6 bits, and 256 types are conveyed using 8 bits. The information is obtained as the user first speaks a voiced speech segment, either during a training period or during the first few glottal periods of voiced speech. When the excitation is needed during voiced speech coding, the function from the catalogue is contracted (or expanded in time) to correspond to the pitch period of the user, and its amplitude is set.

During normal speech a user varies his/her pitch period to convey information such as questioning (pitch up, when pitch period shortens), empathy (pitch drops, and pitch period lengthens) and other well known reasons. This characteristic is known as prosody, and such prosodic information (e.g., pitch inflection up or down) is coded using two bits (4 levels) to code increases or decreases in the pitch period pitch by 5% intervals. This prosodic information is coded approximately 2 times per second, for a bit budget of 6 bps. Prosodic information is coded at the beginning of each voiced speech segment to describe the average pitch contour occurring during the segment.

Timing and Speech Type—The time duration of one or more of the voiced glottal cycles of the user, as transmitted in the header, is used as the unit of time for the preferred coding method. For example, using a 3 second coding period, applicants would use 150 timing intervals, each of 2 glottal cycles duration or 20 msec in duration, to describe the time locations of speech transitions. For voiced speech, once the onset time in "glottal time units" is determined, every subsequent glottal period time location in the voiced speech segment can be described by adding one glottal period to the previous time location. For the example herein, an 8 bit code is used to identify the location of any speech transition, such as onset or end. This gives timing within 20 ms in a sequence of 256 time units. An 8-bit code describes up to 5 seconds of speech (sufficient for the 3 second coding example used herein). The time coding makes use of the fact that the onset time of a speech segment also provides an end time of the preceding speech segment. This method of timing is part of the methods herein. It allows variable length speech segments to be coded and transmitted at a constant bit rate because the coding system in the receiver unit can easily reconstitute the onset times of speech segments, and it can allocate the number of glottal cycles for the voice speech segments and place them in proper order for a listener to hear. In this example, a new speech segment is defined with a new (or updated) header and a new timing sequence after each 5 sec. interval. The actual transmission of timing information in the coding would occur when a change in speech condition occurs, such as silence to voiced onset, such as (segment 1 to 2) at the 0.16 second time in FIG. 3. For example, this time is 8 glottal units. Similarly an unvoiced time segment to silence segment occurs at 1.6 sec in FIG. 3, which is 80 glottal units.

Based on example statistics of American English, and using 3 types of speech, in each 3 second period of normal speech there will be approximately a 1.5 sec segment of voiced speech, two intervals of unvoiced speech lasting 0.3 and 0.5 sec, and silence lasting 0.7 sec. Timing information for onset and for end of the speech segment is needed approximately four times during each 3 second period (to describe the change in speech type), for a bandwidth use of 11 bps. For this average example, 3 types of speech are coded using 2 bits (representing up to 4 types) to describe the type of speech. This 2 bit code is sent, in the example, 4 times each 3 second period, using 3 bps of bandwidth. The number of glottal cycles is determined by the start and end times of the voiced segment, and is 150 in this example (at an example glottal period of 20 ms/timing unit).

Unvoiced Speech Segments—Applicants have shown that segments of unvoiced speech, in American English, occur usually within 300 ms preceding onset of a voiced speech segment and 500 ms following end time of a voiced segment. (These two times, which can be changed as the user requires, are the default times for the preferred method herein). In addition, variations on the timing rule occur, as shown in FIG. 1, where a short (100 msec) unvoiced speech segment containing /tt/ in the word "butter" occurs, or in FIG. 3, where segment 1 is shortened due to the rapid onset of voicing after turn-on. The coding rule for such segments, whose time period is shorter than one of the default times, is that they are coded as one segment of unvoiced speech over the shortened time period. In conditions where the time, T, between voiced segments is longer than either one of the default times, e.g., $T \geqq 500$, $T > 300$ ms but shorter than the combined time of 800 ms, the time segment is split into two unvoiced periods, each of which are processed separately. The first unvoiced time period following the end time of the voiced speech segment, is defined at $T \times 500/800$, and the second time period of the second unvoiced segment, is defined as $T \times 300/800$.

The unvoiced signal over the unvoiced time frame is coded using cepstral processing, yielding 5 cepstral coefficients. These are compared to a catalogue of cepstral coefficients for 8 types of American English unvoiced speech phonemes, such as fricatives, e.g., /ssss/. A prior art algorithm compares measured to stored cepstral coefficients, and one of the 8 catalogued elements is selected as having the closest fit, and its code is transmitted. A three bit code identifies the elements, then 2 bits are used to set the gain relative to the normalized level of the following or preceding voiced speech segment, and 8 bits are used to set the onset time. At a rate of one unvoiced segment occurring per second, the unvoiced segment coding uses 15 bps. A variation in this embodiment is to use two catalogues, the first for unvoiced speech preceding voiced speech, and the second for unvoiced following voiced speech.

Silent Speech or Speech Pauses—Applicants have shown that during times of pause or no-use of the system it is important to code these periods by simply determining the onset time of no speech, which is either the time period until a user starts speaking once the system is started, or the time after the end of a voiced segment plus the 500 msec unvoiced period following the last voiced segment (see segment 7 in FIG. 3 for example). Pause periods can be short or long, but since only the onset time of the pause period is sent using 8 bits, and since they occur approximately 2 times per second, the bit budget is 16 bps. If the silence period lasts longer than a default time, approximately 2 sec in this example, the system returns to waiting for speech onset (see FIG. 7).

Voiced Speech Spectral Information—The applicants have found that the two lowest frequency formants, called 1 and 2, must be described and transmitted for acceptable reconstruction in the receiver unit. Higher formants, commonly called formants 3, 4, 5, etc. carry speech personality information that enable increasing accuracy of speech reconstruction in the receiver, if the user chooses to use more bandwidth to code them. The spectral information for 2 formant's amplitude, and phase values are represented by 2 complex poles and 1 complex zero. An example of the fit of the 2-pole, 1-zero representation of the first 2 formants for the sound /ah/, is shown in FIG. 5. In prior art coding, (e.g., LPC) approximately 10 poles would be needed to fit these two example formants. The inventive method herein, utilizes EM sensor information to determine an excitation function which enables pole and zero coding (e.g., ARMA, ARX techniques). Excitation amplitude can also change, which can be coded a few times each second using 2 or 3 bits.

The applicants have also found that the mathematical description of the spectral values of formants should be updated every two glottal cycles for the 300 bps example. The preferred method of obtaining formants for the preferred enablement is to first obtain and store acoustic information and excitation information over a time period of 2 glottal cycles, then time align the two segments of information, using a prior art cross correlation algorithm to find the time offset when a correlation maximum occurs. Next the excitation function information is removed from the acoustic signal and filter functions or transfer functions are obtained. This process is well known to practitioners in the art of signal processing, and automatically yields the best (e.g., least squares) fit of data to the number of poles and zeros allowed by the user to fit the data. In this embodiment, the minimal coding of voiced speech segments is accomplished by obtaining a 2 pole—one zero fit to the data every two glottal periods.

For voiced speech, looking at FIG. 2 above and at other examples, applicants have shown that spectral value versus time trajectory of each speech formant in a voiced speech segment can be fit by a cubic equation over approximately 300 msec. The cubic curve that follows the formant movement is determined by 3 formant values, coded every 100 msec, over a period of 0.3 sec. The 2 complex pole, one complex zero data yields 6 numbers that are obtained about every 100 msec, or about 10 times per second, for 60 numbers per second. By coding them with 8 bits of information, a bandwidth of 480 bps is obtained to describe voiced speech segments. If more formants are used, or they are coded more often to account for rapid changes in a voiced speech condition, that sometimes occur, a higher bandwidth would be required. Such an example occurs in FIG. 2 at the time 0.82 sec, when the /b/ sound transitions to the /u/ sound. The methods herein allow the user to easily accommodate extended or brief periods of more rapid coding as the objectives allow.

Various embodiments are contemplated. In one embodiment the at least one characteristic of the human speech signal comprises an average glottal period time duration value of voiced speech. In another embodiment the at least one characteristic of the human speech signal comprises an excitation function and its coded description. In another embodiment the excitation function comprises at least one of the following: one numerically parameterized excitation function, one onset of excitation timing function, one directly measured excitation function, and at least one table lookup excitation function. In another embodiment the at least one acoustic microphone provides acoustic sensor signal information and the excitation function is time aligned with the acoustic sensor signal information. In another embodiment the at least one characteristic of the human speech signal comprises time of onset, time duration, and time of end for each of 3 types of speech in a sequences of segments of the speech-types. In another embodiment the at least one characteristic of the human speech signal comprises number of glottal periods and one or more spectral formant values within a continuous segment of voiced speech. In another embodiment the at least one characteristic of the human speech signal comprises the type of unvoiced speech segment, and its amplitude compared to voiced speech. In another embodiment the at least one characteristic of the human speech signal comprises header-information that describes recurring speech properties of the user. In another embodiment the at least one characteristic of the human speech signal comprises one or more of an average glottal period time duration value of voiced speech, an excitation function and its coded description, time of onset, time duration, and time of end for each of 3 types of speech in a sequences of segments of the speech-types, the number of glottal periods and one or more spectral formant values within a continuous segment of voiced speech, the type of unvoiced speech segment, and its amplitude compared to voiced speech, and header-information that describes recurring speech properties of the user. In another embodiment the at least one EM wave sensor comprises a coherent wave EM sensor. In another embodiment the at least one EM wave sensor comprises a coherent wave EM sensor for measuring essential information comprised of air pressure induced tissue movement in the human vocal tract for purposes of glottal timing, excitation function description, and voiced speech segment onset times. In another embodiment the at least one EM wave sensor comprises a coherent optical-frequency EM sensor for obtaining vocal tract wall movement by measuring surface motion of skin tissues connected to the vocal tract wall-tissues.

Apparatus—One type of apparatus is described to enable the use of the methods herein for efficient speech coding. It is a hand held communications unit, both wireless and wired, that resembles a cellular telephone.

Referring now to FIG. 6, a system comprising a handheld wireless telephone unit and used by a user to measure oral cavity, vocal tract wall-tissue movement is shown. The system is designated generally by the reference numeral 600. The system 600 removes excess information from a human speech signal and codes the remaining signal information. The system 600 comprises at least one EM wave sensor 608, at least one acoustic microphone 610, and processing means 609 for removing the excess information from the human speech signal and coding the remaining signal information. The system 600 provides a communication apparatus. The communication apparatus comprises at least one EM wave sensor, at least one acoustic microphone, and processing means for removing excess information from a human speech signal and coding the remaining signal information using one or the at least one EM wave sensor and the at least one acoustic microphone to determine at least one of the following: an average glottal period time duration value and variations of the average value from voiced speech, a voiced speech excitation function and its coded description, time of onset, time duration, and time of end for each of 3 types of speech in a sequences of segments of the speech-types, number of glottal periods and one or more spectral formant values within a continuous segment of voiced speech, the type of unvoiced speech segment, and its amplitude compared to voiced speech, and header-information that describes speech properties of the user.

A small EM sensor 608 and antenna 606, located on the sides of a handheld communications unit 603, in order to measure the vocal tract wall tissues inside the cheek 602 (i.e. inside the oral cavity), and other vocal organs as needed. In addition, the EM sensor 608 and its side mounted antenna 606 measures external cheek skin movement, which is connected to the inner cheek vocal tract wall-tissue and which vibrates together with the inner cheek tissue. The normal acoustic microphone 610, located inside the handheld communications unit 603, receives acoustic speech signals from the user 601. These are combined by a processor 609 with signals from the EM sensor 608 or sensors, using algorithms herein and included by reference, for minimum information (e.g., narrow bandwidth) transmission to a listener. A variation on the hand held EM communicator is for the EM sensor to be built into a cellular telephone format and to use the antenna of a cellular telephone 604 to broadcast both the communications carrier and information, but also to broadcast an EM wave that reflects from the vocal organs (including vocal tract tissue surfaces) and to detect the reflected signals.

By using the apparatus in accordance with the descriptions above, various embodiments of the system 600 are provided. In one embodiment the at least one characteristic of the human speech signal comprises an average glottal period time duration value of voiced speech. In another embodiment the at least one characteristic of the human speech signal comprises an excitation function and its coded description. In another embodiment the excitation function comprises at least one of the following: one numerically parameterized excitation function, one onset of excitation timing function, one directly measured excitation function, and at least one table lookup excitation function. In another embodiment the at least one acoustic microphone provides acoustic sensor signal information and the excitation function is time aligned with the acoustic sensor signal information. In another embodiment the at least one characteristic of the human speech signal comprises time of onset, time duration, and time of end for each of 3 types of speech in a sequences of segments of the speech-types. In another embodiment the at least one characteristic of the human speech signal comprises number of glottal periods and one or more spectral formant values within a continuous segment of voiced speech. In another embodiment the at least one characteristic of the human speech signal comprises the type of unvoiced speech segment, and its amplitude compared to voiced speech. In another embodiment the at least one characteristic of the human speech signal comprises header-information that describes speech properties of the user. In another embodiment the at least one characteristic of the human speech signal comprises one or more of an average glottal period time duration value of voiced speech, an excitation function and its coded description, time of onset, time duration, and time of end for each of 3 types of speech in a sequences of segments of the speech-types, the number of glottal periods and one or more spectral formant values within a continuous segment of voiced speech, the type of unvoiced speech segment, and its amplitude compared to voiced speech, and header-information that describes essential, repetitive speech properties of the user. In another embodiment the at least one EM wave sensor comprises a coherent wave EM sensor. In another embodiment the at least one EM wave sensor comprises a coherent wave EM sensor for measuring essential information comprised of air pressure induced tissue movement in the human vocal tract for purposes of glottal timing, excitation function description, and voiced speech segment onset times. In another embodiment the at least one EM wave sensor comprises a coherent optical-frequency EM sensor for obtaining vocal tract wall movement by measuring surface motion of skin tissues connected to the vocal tract wall-tissues.

Transmission Formats—The method of coding herein, further illustrated in FIG. 7, relies on characterizing the user's speech over the time duration of each of the 3 types of speech segment used in these embodiments (length of silence, unvoiced, or voiced speech) in order to remove excess information (to the degree desired by the user) and to code the speech in a format to meet the constraints of the user, which include latency times (i.e., time delay in receiving speech of sender) and limited coding bandwidth (i.e., bits per second). The minimal bandwidth example of the preferred embodiment requires about 1 sec of delay before the minimal speech information is transmitted (at the user chosen limiting coding rate, e.g., 300 bps) and (assuming instant connectivity) is received and heard by a listener, as the speech is reconstituted after information on each segment is received. In the case of a voiced speech segment, which can use 400–800 bps for coding, depending on the degree of speaker speech personality desired, up to 2 seconds or more of latency can occur before the 1 second voiced segment is reconstructed for the listener. This example assumes 1 second of coding delay and about 1.5 second (at 300 bps) to transmit 1 second of a voiced speech segment which is coded using 480 bps. In many situations, the control algorithm can code the user's speech and transmit it according to latency and bandwidth constraints. For example, it will cut long voiced speech segments into 2 or more shorter segments and send them one after the other, to meet the latency and bandwidth requirements. This action is easily accomplished by the methods herein because an artificial "end-of-voiced-speech" segment, is followed immediately by an "onset-of-speech" of the following voiced speech segment. This cut may cost up to an extra 8 bits to code the new onset time of the second segment (which is the same as the end time of the first segment). This example shows the extra coding bandwidth to be low, and illustrates the variety of formats available to the user of these methods.

Figure 8A:
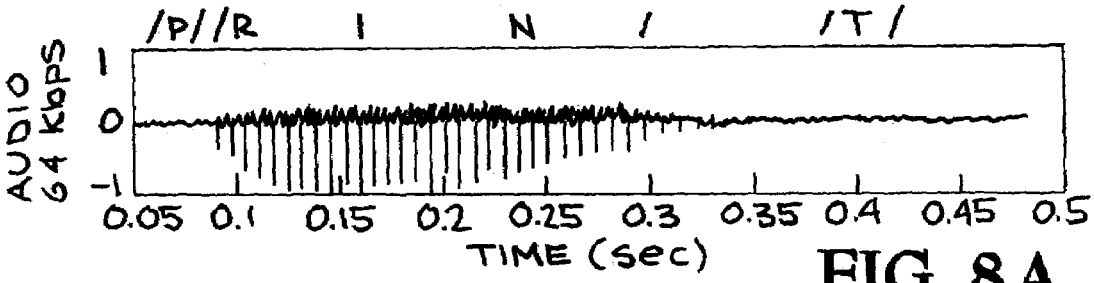
FIG. 8 shows a reconstructed example using 266 bps coding.
Figure 8B:
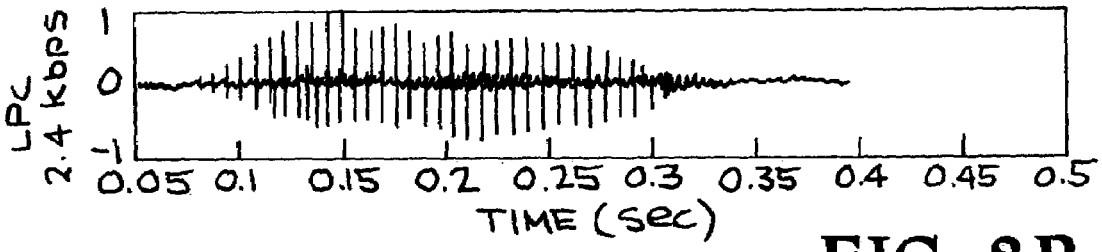
Figure 8C:
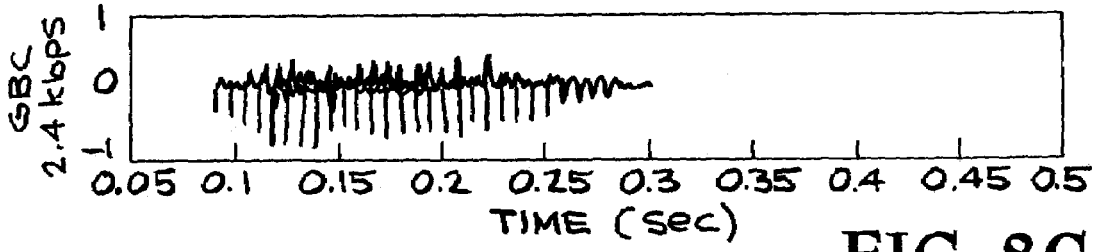
Figure 8D:
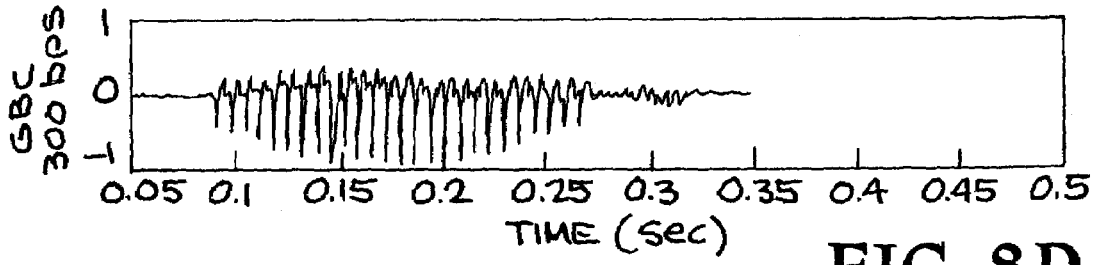

Over the example of 3 seconds of coding, the statistics of a typical American English speech example show that 50% of the time is used by voiced speech segments (i.e., 1.5 sec), 30% by two unvoiced segments (i.e., 1 sec), and one pause using 20% of the time (i.e., 0.6 sec). The enablement of minimal bandwidth coding leads to the following bit budget over the 3 second coded interval. The voiced coding uses 480 bps×1.5 sec=720 bits, the unvoiced segment coding uses 15 bps/segment×2 segments×1 sec=30 bps, and the pause uses 16 bps×0.6 sec=10 bits. If this information is uniformly transmitted over a 3 sec. Interval, the bits add to 760 bits, plus header bits of 40 bits for a total of 800 bits/3 seconds=266 bps of transmission. The reconstructed speech in the receiver unit, using the inverse of the algorithms used to code the initial speech segments, leads to speech sounds very intelligible to listeners. The reconstructed signal versus time, for the 266 bps example, is shown in FIG. 8D. The initial acoustic speech segment FIG. 8A, a prior art coded speech (at 2.4 kbps) FIG. 8B, and a 2.4 kbps signal coded using methods herein, FIG. 8C, are also shown.

This particular example is chosen to show how an existing speech segment that may use 2400 bps to code (using prior art methods), can have excess information removed, be coded with some degree of personality loss but with good intelligibility, and be sent using a constant bandwidth less than 300 bps and with about 1.5 sec or less of latency. If the user wanted less latency, the bandwidth could be doubled to about 500 bps and the latency reduced to less than 0.75 sec. Conversely, if improved speech personality is desired a $3^{rd}$ and $4^{th}$ extra formant could be coded (adding 480 bits more over the 3 seconds), thus requiring the transmission bandwidth to increase by about 160 bps to 420 bps, or the latency could be increased by about 0.5 seconds to accommodate the extra 160 bits at a rate of 300 bps.

Systems have been described for removing excess information from a human speech signal and coding the remaining signal information. The systems comprise at least one EM wave sensor, at least one acoustic microphone, and processing means for removing the excess information from the human speech signal and coding the remaining signal information using the at least one EM wave sensor and the at least one acoustic microphone to determine at least one characteristic of the human speech signal. The systems provide a communication apparatus. The communication apparatus comprises at least one EM wave sensor, at least one acoustic microphone, and processing means for removing excess information from a human speech signal and coding the remaining signal information using one or the at least one EM wave sensor and the at least one acoustic microphone to determine at least one of the following: an average glottal period time duration value and variations of the value from voiced speech, a voiced speech excitation function and its coded description, time of onset, time duration, and time of end for each of 3 types of speech in a sequences of segments of the speech-types, number of glottal periods and one or more spectral formant values within a continuous segment of voiced speech, the type of unvoiced speech segment, and its amplitude compared to voiced speech, and header-information that describes speech properties of the user. The systems include a method of removing excess information from a human speech signal and coding the remaining signal information using one or more EM wave sensors and one or more acoustic microphones to determine at least one characteristic of the human speech signal.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system for removing excess information from a human speech signal and coding the remaining signal information, comprising:

at least one EM wave sensor, at least one acoustic microphone, processing means for removing said excess information from said human speech signal that produces a remaining signal, and processing means for coding said remaining signal to provide a coded signal;

wherein said processing means for removing said excess information and said processing means for coding said remaining signal uses said at least one EM wave sensor and said at least one acoustic microphone to determine at least one characteristic of said human speech signal.

2. The system for removing excess information from a human speech signal and coding the remaining signal information of claim 1 wherein said at least one characteristic of said human speech signal comprises an average glottal period time duration value of voiced speech.

3. The system for removing excess information from a human speech signal and coding the remaining signal information of claim 1 wherein said at least one characteristic of said human speech signal comprises an excitation function and its coded description.

4. The system of claim 3 wherein said excitation function comprises at least one of the following: one numerically parameterized excitation function, one onset of excitation timing function, one directly measured excitation function, and at least one table lookup excitation function.

5. The system of claim 3 wherein said at least one acoustic microphone provides acoustic sensor signal information and said excitation function is time aligned with said acoustic sensor signal information.

6. The system for removing excess information from a human speech signal and coding the remaining, signal information of claim 1 wherein said at least one characteristic of said human speech signal comprises time of onset, time duration, and time of end for each type of speech in a sequences of segments of said speech-types.

7. The system of claim 1, where said at least one characteristic includes at least 3 types of speech.

8. The system for removing excess information from a human speech signal and coding the remaining signal information of claim 1 wherein said at least one characteristic of said human speech signal comprises number of glottal periods and one or more spectral formant values within a continuous segment of voiced speech.

9. The system for removing excess information from a human speech signal and coding the remaining signal information of claim 1 wherein said at least one characteristic of said human speech signal comprises the type of unvoiced speech segment, and its amplitude compared to voiced speech.

10. The system for removing excess information from a human speech signal and coding the remaining signal information of claim 1 wherein said at least one characteristic of said human speech signal comprises header-information that describes speech properties of the user.

11. The system for removing excess information from a human speech signal and coding the remaining signal information of claim 1 wherein said at least one characteristic of said human speech signal comprises one or more of an average glottal-period's time-duration value of voiced speech, an excitation function and its coded description, time of onset, time duration, and time of end for each of 3 types of speech in a sequences of segments of said speech-types, the number of glottal periods, variations in glottal period durations, and one or more spectral formant values within a continuous segment of voiced speech, the type of unvoiced speech segment, and its amplitude compared to voiced speech, and header-information that describes recurring speech properties of the user.

12. The system for removing excess information from a human speech signal and coding the remaining signal information of claim 1 wherein said at least one EM wave sensor comprises a coherent wave EM sensor.

13. The system for removing excess information from a human speech signal and coding the remaining signal information of claim 1 wherein said at least one EM wave sensor comprises a coherent wave EM sensor for measuring essential information comprised of air-pressure-induced tissue movement in the human vocal tract for purposes of glottal timing, excitation function description, and voiced speech segment onset times.

14. The system for removing excess information from a human speech signal and coding the remaining signal information of claim 1 wherein said at least one EM wave sensor comprises a coherent optical-frequency EM sensor for obtaining vocal tract wall movement by measuring surface motion of skin tissues connected to said vocal tract wall-tissues.

15. A method of removing excess information from a human speech signal and coding the remaining signal information, comprising the steps of:

producing a human speech signal using one or more EM wave sensors and one or more acoustic microphones, using processing means for removing excess information from said human speech signal and producing a remaining signal, and using processing means for coding said remaining signal to provide a coded signal to determine at least one characteristic of said human speech signal.

16. The method of removing excess information from a human speech signal and coding the remaining signal information of claim 15 wherein said at least one characteristic of said human speech signal comprises an average glottal period time duration value of voiced speech.

17. The method of removing excess information from a human speech signal and coding the remaining signal information of claim 15 wherein said at least one characteristic of said human speech signal comprises an excitation function and its coded description.

18. The method of removing excess information from a human speech signal and coding the remaining signal information of claim 15 wherein said at least one characteristic of said human speech signal comprises time of onset, time duration, and time of end for each type of speech in a sequences of segments of said speech-types.

19. The method removing excess information from a human speech signal and coding the remaining signal information of claim 15 wherein said at least one characteristic of said human speech signal comprises time of onset, time duration, and time of end for each of 3 types of speech.

20. The method of removing excess information from a human speech signal and coding the remaining signal information of claim 15 wherein said at least one characteristic of said human speech signal comprises the number of glottal periods and one or more spectral formant values within a continuous segment of voiced speech.

21. The method of removing excess information from a human speech signal and coding the remaining signal information of claim 15 wherein said at least one characteristic of said human speech signal comprises the type of unvoiced speech segment, and its amplitude compared to voiced speech.

22. The method of removing excess information from a human speech signal and coding the remaining signal information of claim 15 wherein said at least one characteristic of said human speech signal comprises header-information that describes speech properties of the user.

23. The method of removing excess information from a human speech signal and coding the remaining signal information of claim 15 wherein said at least one characteristic of said human speech signal comprises one or more of an average glottal-period's time-duration-value of voiced speech, an excitation function and its coded description, time of onset, time duration, and time of end for each of 3 types of speech in a sequences of segments of said speech-types, number of glottal periods and one or more spectral formant values within a continuous segment of voiced speech, the type of unvoiced speech segment, and its amplitude compared to voiced speech, and header-information that describes speech properties of the user.

24. The method of removing excess information from a human speech signal and coding the remaining signal information of claim 15 wherein said step of using one or more EM wave sensors comprises using one or more coherent wave EM sensors.

25. The method of removing excess information from a human speech signal and coding the remaining signal information of claim 15 wherein said step of using one or more EM wave sensors comprises using a coherent wave EM sensor to measure air pressure induced tissue movement in the human vocal tract for purposes of glottal timing, excitation function description, and voiced speech segment onset times.

26. The method of removing excess information from a human speech signal and coding the remaining information of claim 15 wherein said step of using one or more EM wave sensors comprises using a coherent optical-frequency EM sensor for obtaining vocal tract wall movement by measuring surface motion.

27. The method of removing excess information from a human speech signal and coding the remaining signal information of claim 15 wherein the remaining signal information is coded and transmitted at a constant bandwidth.

28. The method of removing excess information from a human speech signal and coding the remaining signal information of claim 15 wherein the bandwidth and latency are adjusted to meet user applications.

29. The method of removing excess information from a human speech signal and coding the remaining signal information of claim 15 in which constant bit rate transmission coding uses coding of speech segment onset times and end times, coding of speech segments according to their type, coding of the number and duration of glottal cycles of the user in each voiced speech segment as a function of user defined latency and bandwidth limitations.

30. The method of removing excess information from a human speech signal and coding the remaining signal information of claim 15 wherein the coded and transmitted signal is reconstructed into real time speech segments and then into speech phrases which meet the intelligibility objectives of the listener.

31. A communication apparatus, comprising:

at least one EM wave sensor, at least one acoustic microphone, and processing means for removing excess information from a human speech signal that produces a remaining signal, and processing means for coding said remaining signal to provide a coded signal;

wherein said processing means for removing said excess information and said processing means for coding said remaining signal uses said at least one EM wave sensor and said at least one acoustic microphone to determine at least one of the following:

an average glottal period time duration value and variations of the average value from voiced speech a voiced speech excitation function and its coded description time of onset, time duration, and time of end for each type of speech in a sequence of segments of said speech-types number of glottal periods and one or more spectral formant values within a continuous segment of voiced speech the type of unvoiced speech segment, and its amplitude compared to voiced speech header-information that describes speech properties of the user.

32. The apparatus of claim 31 which comprises a hand held wireless telephone transmission and receiving communications device, containing:

a EM wave generator, transmitting structure, and receiver for measuring vocal organ movements, an acoustic microphone, a processor and algorithms for removing excess speech information and for coding remaining information, and for formatting said coding into a transmission formant meeting the specifications of the communications channel to which said apparatus is attached.

33. The apparatus of claim 31 including a processor and algorithms for decoding information received from another user of methods herein whereby the received information is formatted into intelligible speech.

34. The apparatus of claim 31 in which a wireless transmitting antenna, transmitter, and receiver also serve as a vocal organ measuring EM sensor.

35. A system for removing excess information characterizing a human speech signal, and coding the remaining signal information, comprising:

at least one EM wave sensor, at least one acoustic microphone, processing means for removing said excess information from said acoustic microphone signal and from said EM sensor signal that produces a remaining signal, and processing means for coding said remaining information to provide a coded signal with at least one characteristic of said human speech signal.

* * * * *